US008106839B2

(12) United States Patent
Tsai et al.

(10) Patent No.: US 8,106,839 B2
(45) Date of Patent: Jan. 31, 2012

(54) MULTI-BAND ANTENNA

(75) Inventors: Yung-Chih Tsai, Taipei (TW); Kai Shih, Taipei (TW); Jia-Hung Su, Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 352 days.

(21) Appl. No.: 12/568,674

(22) Filed: Sep. 29, 2009

(65) Prior Publication Data

US 2011/0074636 A1 Mar. 31, 2011

(51) Int. Cl.
*H01Q 1/24* (2006.01)

(52) U.S. Cl. ..... 343/702

(58) Field of Classification Search ..... 343/700 MS, 343/702, 718, 728, 741, 866, 876
See application file for complete search history.

(56) References Cited

U.S. PATENT DOCUMENTS

| | | | | |
|---|---|---|---|---|
| 7,339,531 | B2 * | 3/2008 | Desclos et al. | 343/702 |
| 7,564,411 | B2 * | 7/2009 | Piisila et al. | 343/702 |
| 2002/0024472 | A1 * | 2/2002 | Thursby et al. | 343/741 |
| 2006/0181464 | A1 * | 8/2006 | Erkocevic | 343/702 |
| 2007/0176835 | A1 * | 8/2007 | Qi et al. | 343/702 |

* cited by examiner

*Primary Examiner* — Huedung Mancuso

(57) ABSTRACT

A multi-band antenna has a strip-shaped first radiating portion disposed levelly. An end of a long side of the first radiating portion is extended downwardly to form a first grounding portion. A strip-shaped second radiating portion is disposed in alignment with and spaced from the first radiating portion. A long side of the second radiating portion is extended downwards to form a feeding portion at an end thereof away from the first radiating portion. A third radiating portion, which is stretched levelly and oppositely from an end of the second radiating portion adjacent to the feeding portion, is longer than the second radiating portion and has a long side extended downwardly to form a fixing portion adjacent to a free end thereof. The feeding portion and the fixing portion are located at the same side as the first grounding portion with respect to the first, second and third radiating portion.

5 Claims, 4 Drawing Sheets

| Frequency (MHz) | Total Radiant Power | Equivalent Isotropically Radiated Power | Efficiency(%) | Average Efficiency(%) |
|---|---|---|---|---|
| 2300 | -4.46 | 1.38 | 35.82 | 44.26 |
| 2402 | -3.38 | 2.60 | 45.93 | |
| 2412 | -3.11 | 2.90 | 48.85 | |
| 2437 | -3.03 | 3.20 | 49.83 | |
| 2441 | -3.02 | 3.35 | 49.85 | |
| 2462 | -2.74 | 4.01 | 53.18 | |
| 2480 | -2.49 | 4.36 | 56.32 | |
| 2600 | -4.80 | 2.19 | 33.11 | |
| 2700 | -5.94 | 0.49 | 25.49 | |

FIG. 3

| Frequency (MHz) | Total Radiant Power | Equivalent Isotropically Radiated Power | Efficiency(%) | Average Efficiency(%) |
|---|---|---|---|---|
| 3300 | -4.82 | 0.11 | 32.93 | 36.70 |
| 3400 | -3.81 | 1.71 | 41.63 | |
| 3500 | -3.69 | 1.96 | 42.79 | |
| 3600 | -4.38 | 1.81 | 36.45 | |
| 3700 | -4.75 | 1.21 | 33.47 | |
| 3800 | -4.83 | 0.43 | 32.92 | |

FIG. 4

| Frequency (MHz) | Total Radiant Power | Equivalent Isotropically Radiated Power | Efficiency(%) | Average Efficiency(%) |
|---|---|---|---|---|
| 4900 | -5.41 | 1.51 | 28.75 | 30.08 |
| 5150 | -4.60 | 0.87 | 34.68 | |
| 5350 | -4.70 | 1.08 | 33.88 | |
| 5470 | -4.63 | 1.27 | 34.40 | |
| 5725 | -5.92 | 0.58 | 25.56 | |
| 5875 | -6.34 | 0.46 | 23.20 | |

FIG. 5

MULTI-BAND ANTENNA

BACKGROUND OF THE INVENTION

1. Field of the Invention

The present invention relates to an antenna, and more specifically to a multi-band antenna applied on a portable electronic device.

2. The Related Art

With the constant development of the electronic technology, the wireless communication technology is well developed and progressed, too. For instance, Worldwide Interoperability for Microwave Access (WiMAX) is a wireless digital communication system, also known as IEEE802.16, that is intended for wireless "metropolitan area networks". The WiMAX can provide Broadband Wireless Access (BWA) up to 30 miles (50 km) for the fixed stations, and 3-10 miles (5-15 km) for the mobile stations. The WiMAX, which can be used for wireless networking the same as the currently common Wireless Fidelity (WiFi) protocol, referred to as a second-generation protocol, allows for more efficient bandwidth use, interference avoidance, and is intended to allow high data rates over a long distance, so as to be used widely on portable electronic devices, such as notebook computers. A wireless LAN (or WLAN, for wireless local area network, sometimes referred to as LAWN, for local area wireless network) is one in which a mobile user can connect to a local area network (LAN) through a wireless (radio) connection. The WLAN has a maximum data rate of 11 Mbit/s. At present, most of the portable electronic devices are equipped with multi-band antennas which can receive and send multiple frequency bands provided by the WiMAX and the WLAN. However, the conventional multi-band antennas generally have lower efficiency of receiving and sending signals, not good enough to meet the demands of the users. Therefore, it is desirable to design a multi-band antenna having better efficiency for receiving and sending signals.

SUMMARY OF THE INVENTION

An object of the invention is to provide a multi-band antenna with an excellent performance. The multi-band antenna adapted for being mounted to a support of a portable electronic device has a strip-shaped first radiating portion disposed levelly to cover a top of the support of the portable electronic device. An end of a long side of the first radiating portion is extended downwardly to form a first grounding portion. A strip-shaped second radiating portion is disposed in alignment with and spaced from the first radiating portion with a predetermined distance. A long side of the second radiating portion is extended downwards to form a feeding portion at an end thereof away from the first radiating portion. The feeding portion is located at the same side as the first grounding portion with respect to the first and second radiating portion. A strip-shaped third radiating portion is stretched levelly and oppositely from an end of the second radiating portion adjacent to the feeding portion. The third radiating portion is longer than the second radiating portion and has a long side extended downwardly to form a fixing portion adjacent to a free end thereof. The fixing portion is located at the same side as the feeding portion with respect to the second and third radiating portion.

As described above, the multi-band antenna has the first radiating portion for receiving and sending electrical signals from the frequency band around 5000 MHz, the third radiating portion for receiving and sending electrical signals from the frequency band around 2000 MHz. The first radiating portion and the second radiating portion have influence on each other to result in parasitic effect, for receiving and sending the electrical signals from the frequency band around 3000 MHz. Thus the multi-band antenna is capable of transmitting multiple frequency bands, meanwhile, has better efficiency.

BRIEF DESCRIPTION OF THE DRAWINGS

The invention, together with its objects and the advantages thereof may be best understood by reference to the following description taken in conjunction with the accompanying drawings, in which:

FIG. 3 is a table showing the efficiency against frequency between 2300 MHz and 2700 MHz for the multi-band antenna shown in FIG. 1;

FIG. 4 is a table showing the efficiency against frequency between 3300 MHz and 3800 MHz for the multi-band antenna shown in FIG. 1; and FIG. 5 is a table showing the efficiency against frequency between 4900 MHz and 5875 MHz for the multi-band antenna shown in FIG. 1.

DETAILED DESCRIPTION OF THE EMBODIMENT

Figure 1:
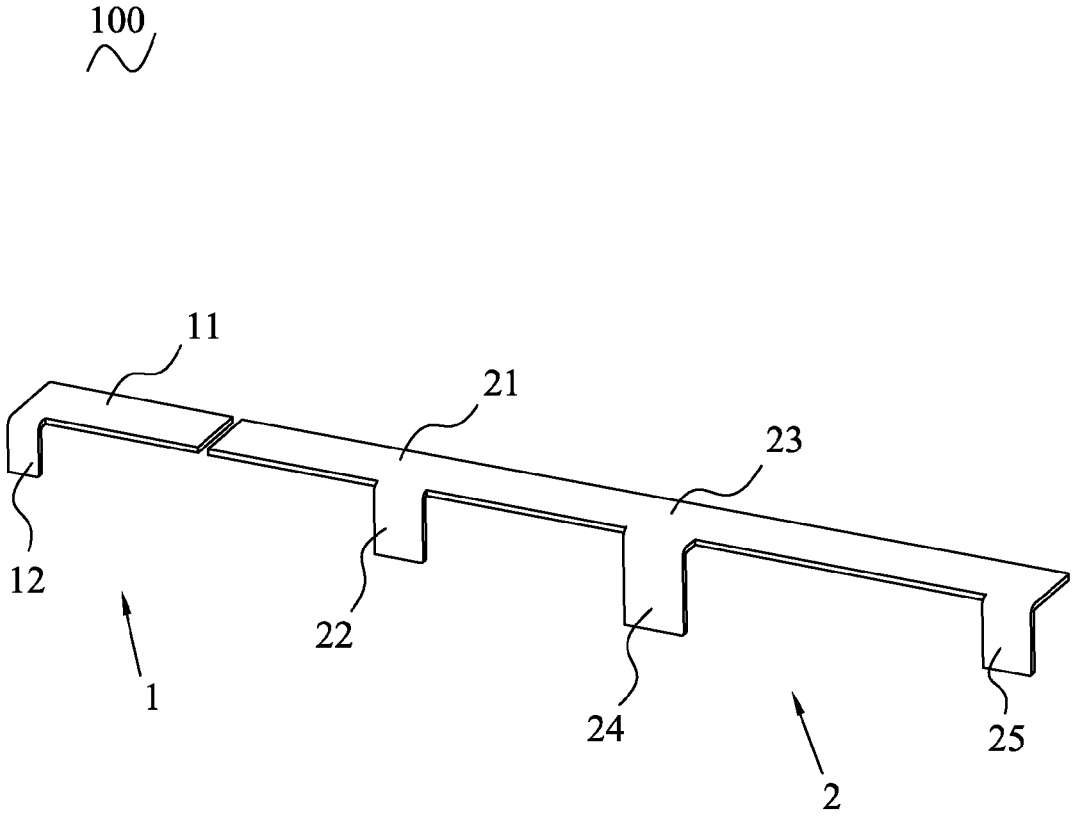
FIG. 1 is a perspective view illustrating the structure of a multi-band antenna of an embodiment in accordance with the present invention.

With Reference to FIG. 1, an embodiment of a multi-band antenna 100 according to the present invention is shown. The multi-band antenna 100 may be manufactured by means of punching and bending a metal plate and includes a first radiator 1 and a second radiator 2. The first radiator 1 has a first radiating portion 11 of strip shape. The first radiating portion 11 is disposed levelly to lie on a top of a support of a notebook computer (not shown). An end of a long side of the first radiating portion 11 is extended downwards to form a first grounding portion 12. The first grounding portion 12 is a rectangular-slice shape and adapted for being grounded.

The second radiator 2 has a second radiating portion 21 of strip shape, with a length thereof substantially the same as that of the first radiating portion 11. The second radiating portion 21 is disposed to align with the first radiating portion 11, with a gap formed therebetween. A long side of the second radiating portion 21 has a portion extended downwards to form a feeding portion 22 at an end thereof away from the first radiator 1. The feeding portion 22 is located at the same side as the first grounding portion 12 with respect to the first and second radiating portion 11, 21. An end of the second radiating portion 21 opposite to the first radiator 1 is stretched levelly to form a third radiating portion 23. The third radiating portion 23 is longer than the second radiating portion 21 in length. A long side of the third radiating portion 23 is extended downwards to form a second grounding portion 24 at a substantial middle thereof and a fixing portion 25 at an end thereof away from the feeding portion 22. The second grounding portion 24 and the fixing portion 25 are both disposed at the same side as the feeding portion 22 with respect to the second radiating portion 21 and the third radiating portion 23. The position of the second grounding portion 24 connected with the third radiating portion 23 can be varied with respect to the feeding portion 22, for adjusting the frequency bandwidth of the multi-band antenna 100. The fixing portion 25 is fixed to the notebook computer for preventing the third radiating portion 23 attached to the top of the support of the notebook computer from deforming. In this embodiment, the first grounding portion 12, the feeding portion 22, the second grounding portion 24 and the fixing portion 25 are substantially in alignment with one another.

When the multi-band antenna 100 operates at wireless communication, a current is fed from the feeding portion 22, runs through the first radiating portion 11 and reaches the first grounding portion 12 to result in a resonant mode, for receiving and sending electrical signals from the frequency band around 5000 MHz. The current is fed from the feeding portion 22, runs through the second and third radiating portion 21, 23 and reaches the fixing portion 25 to generate electrical resonance corresponding to the frequency band around the 2000 MHz. The first radiating portion 11 and the second radiating portion 21 have influence on each other to result in parasitic effect, which makes the first radiating portion 11 and the second radiating portion 21 be capable of receiving and sending the electrical signals from the frequency band around 3000 MHz.

Figure 2:
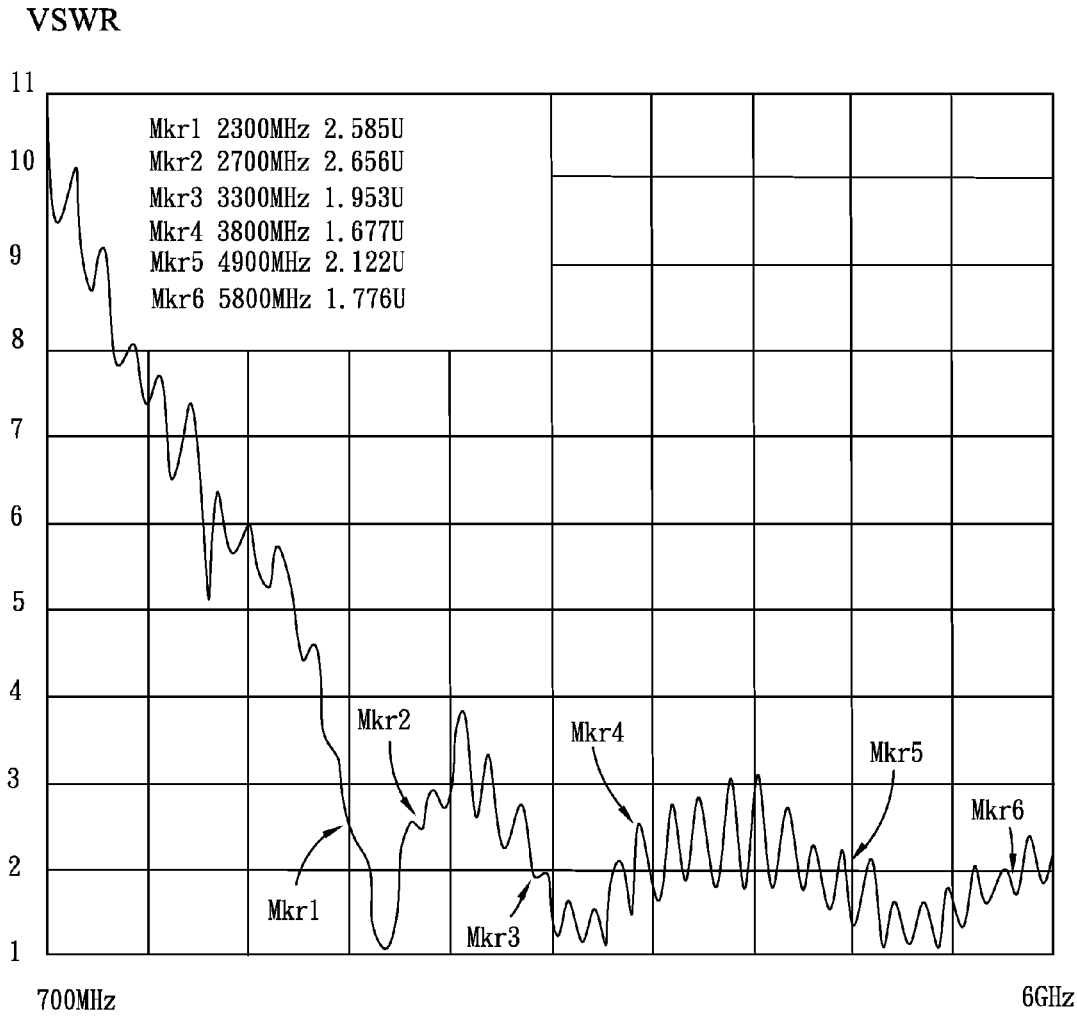
FIG. 2 shows a Voltage Standing Wave Ratio (VSWR) test chart of the multi-band antenna shown in FIG. 1.

FIG. 2 shows a Voltage Standing Wave Ratio (VSWR) test chart of the multi-band antenna 100 when the multi-band antenna 100 operates at wireless communication. When the multi-band antenna 100 operates at a frequency of 2300 MHz (Mkr1 in FIG. 2), the resulting VSWR value is 2.585. When the multi-band antenna 100 operates at a frequency of 2700 MHz (Mkr2 in FIG. 2), the resulting VSWR value is 2.656. When the multi-band antenna 100 operates at a frequency of 3300 MHz (Mkr3 in FIG. 2), the resulting VSWR value is 1.953. When the multi-band antenna 100 operates at a frequency of 3800 MHz (Mkr4 in FIG. 2), the resulting VSWR value is 1.677. When the multi-band antenna 100 operates at a frequency of 4900 MHz (Mkr5 in FIG. 2), the resulting VSWR value is 2.122. When the multi-band antenna 100 operates at a frequency of 5800 MHz (Mkr6 in FIG. 2), the resulting VSWR value is 1.776.

Reference are now made to FIGS. 3-5, which show the efficiency against frequency in MHz for the multi-band antenna 100. When the multi-band antenna 100 operates at the frequency range covering between 2300 MHz and 2700 MHz, the efficiency is between 25.49 percentages and 56.32 percentages, and the average efficiency is 44.26 percentages. When the multi-band antenna 100 operates at the frequency range covering between 3300 MHz and 3800 MHz, the efficiency is between 32.92 percentages and 42.79 percentages, and the average efficiency is 36.70 percentages. When the multi-band antenna 100 operates at the frequency range covering between 4900 MHz and 5875 MHz, the efficiency is between 23.20 percentages and 34.68 percentages, and the average efficiency is 30.08 percentages.

As described above, the multi-band antenna 100 is capable of transmitting the electrical signals from the frequency bands ranging from 2300 MHz to 2700 MHz, 3300 MHz to 3800 MHz, 4900 MHz to 5875 MHz. Meanwhile, the average efficiency of each frequency band will be better. Furthermore, the structure of the multi-band antenna 100 is simple and complanate, which is easy to be manufactured. Therefore, the multi-band antenna 100 has better performance of operation at wireless communication and is suitable to spread and use.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A multi-band antenna adapted for being mounted to a support of a portable electronic device, comprising:

a strip-shaped first radiating portion disposed levelly to lie on a top of the support of the portable electronic device, an end of a long side of the first radiating portion extended downwardly to form a first grounding portion;

a strip-shaped second radiating portion, the second radiating portion disposed in alignment with and spaced from the first radiating portion with a predetermined distance, a long side of the second radiating portion extended downwards to form a feeding portion at an end thereof away from the first radiating portion, the feeding portion located at the same side as the first grounding portion with respect to the first and second radiating portion; and a strip-shaped third radiating portion stretched levelly and oppositely from an end of the second radiating portion adjacent to the feeding portion, the third radiating portion being longer than the second radiating portion and having a long side extended downwardly to form a fixing portion adjacent to a free end thereof, the fixing portion located at the same side as the feeding portion with respect to the second and third radiating portion.

2. The multi-band antenna as claimed in claim 1, wherein the third radiating portion has a second grounding portion at a substantial middle of the long side thereof for enlarging the frequency bandwidth.

3. The multi-band antenna as claimed in claim 2, wherein the first grounding portion, the feeding portion, the second grounding portion and the fixing portion are substantially in alignment with one another.

4. The multi-band antenna as claimed in claim 1, wherein the first radiating portion is substantially the same as the second radiating portion in length.

5. The multi-band antenna as claimed in claim 1, wherein the fixing portion is fixed to the support of the portable electronic device for preventing the third radiating portion from deforming.

* * * * *